United States Patent [19]

Helpinstill, II

[11] 4,145,944

[45] Mar. 27, 1979

[54] GUITAR PICK-UP APPARATUS

[76] Inventor: Charles T. Helpinstill, II, 5808 S. Rice Ave., Houston, Tex. 77081

[21] Appl. No.: 871,227

[22] Filed: Jan. 23, 1978

[51] Int. Cl.[2] ..... G10H 3/00

[52] U.S. Cl. ..... 84/1.16; 84/1.14; 84/1.15

[58] Field of Search ..... 84/1.14–1.16

[56] References Cited

U.S. PATENT DOCUMENTS

| | | | |
|---|---|---|---|
| 3,539,700 | 11/1970 | Johnson | 84/1.16 |
| 3,571,483 | 3/1971 | Davidson | 84/1.15 X |
| 3,595,981 | 7/1971 | Hopping | 84/1.16 |

*Primary Examiner*—Ulysses Weldon
*Attorney, Agent, or Firm*—Donald Gunn

[57] ABSTRACT

A pick-up for attachment to a guitar or the like is disclosed. The pick-up comprises an elongate flexible body having a thin, lower, magnetic base which affixes to the body of the guitar with an adhesive, the base comprising a sheet magnet. The sheet magnet is cut in the form of a rectangle, and it approximately matches the profile of a second sheet magnet cut in approximately the same rectangular shape. The second magnet serves as a core for supporting a coil wrapped around it on the periphery. The magnet and the coil wrapped around it are together sandwiched between opposite layers of sheet tin foil to serve as shielding. This, in turn, is placed in a plastic body which is shrink-wrapped around the turns of the coil. The lower magnet adhesively affixed to the body transfers vibrations from the body into the coil in the form of electrical signals. In addition, strings made of magnetic material co-act with the upper magnet to additionally form electrical signals. These two signal sources provide a high fidelity pick-up system whereby music is converted into an electrical signal from the guitar which is amplified by other equipment.

6 Claims, 4 Drawing Figures

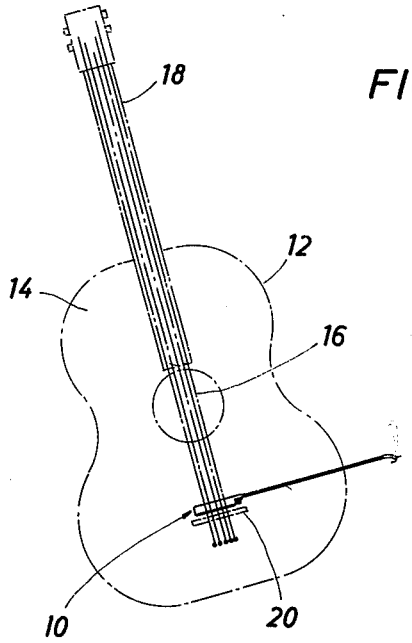
FIG. 1
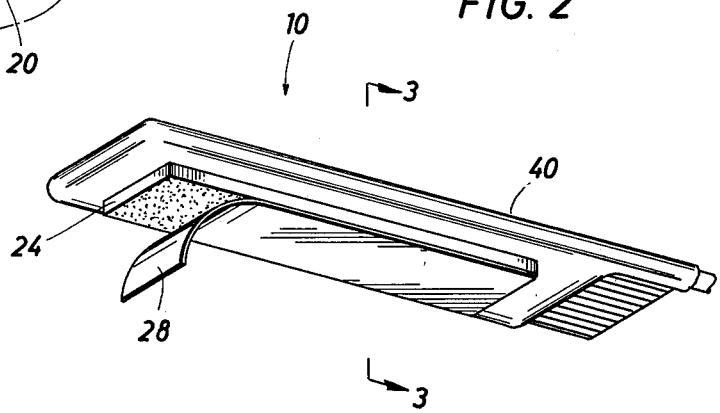
FIG. 2
FIG. 3
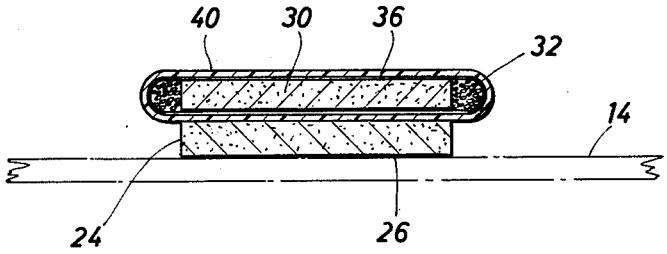
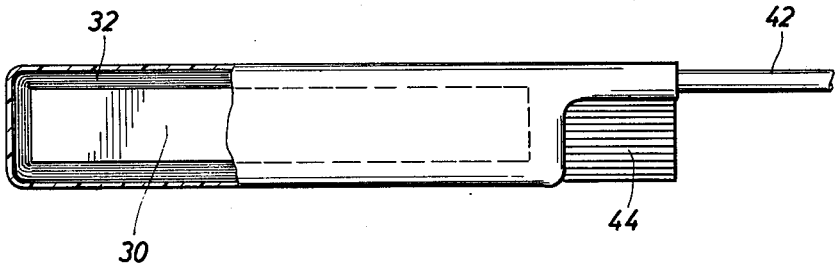
FIG. 4

GUITAR PICK-UP APPARATUS

BACKGROUND OF THE DISCLOSURE

A guitar has a certain volume level which is limited. In many instances, it is adequate for a small crowd or a relatively small room. In other instances, an acoustic guitar is simply too small and not sufficiently audible to fill a large concert hall, nightclub or other facility with sound, and the sound must be boosted by an amplification system. Various and sundry types of signal pick-ups have been used heretofore. Detectors which detect the sound of a given string or of all guitar strings as a unit have been employed. The present invention is a device which is particularly able to pick up the sound with all the richness of the acoustic guitar. It is particularly advantageous over string pick-up devices known heretofore. Many string pick-up devices previously used have simply responded to string movement. String vibration is the beginning of guitar sound, but it is not the complete guitar sound. A guitar is distinctive from other string instruments, such as a mandolin, ukelele and so on. These differences show up in the vibration modes which are enhanced or suppressed by the shape of the body of the acoustical string instrument. The quality of sound thus is, in large part, dependent on vibrations in the instrument body, not solely in the instrument string. The present invention is able to pick up both types of vibrations and convert them into an electrical signal. The signal, itself, then can be amplified in the customary manner.

The present invention thus merges two types of vibratory movement into a single, electrical signal. The signal can then thereafter be easily amplified. The present invention picks up both types of movement; movement of the string and movement of the guitar body. The present invention further is enhanced in its performance by converting the mechanical vibrations into electrical signals of an amplitude which is easily worked with. The amplitude is certainly not down in the microvolt region. It is not so small as to be highly susceptible to noise. Rather, it provides an output signal in the millivolt region which is easily amplified.

The present invention is a pick-up which can be added to an acoustic guitar and removed after its use. It affixes to the guitar in a very simple fashion, and it is able to be removed in a similarly easy manner.

BRIEF SUMMARY OF THE DISCLOSED INVENTION

The present invention is an apparatus adapted to be attached to a guitar for picking up the vibrations of the guitar and converting them into an electrical signal for subsequent amplification. The device includes an elongate rectangular body. The body is formed of a bottom magnet with an adhesive material joining it to the body of the guitar, preferably under the strings, between the sound hole and approximately parallel to the bridge of the guitar. The magnet is in the form of a sheet magnet, shaped into a rectangle. A second magnetic body, having approximately the same dimensions and magnetic power and also formed of a sheet magnet, is placed thereabove. The second magnet serves as a core for a coil which is wound about it, and layers of tin foil are wrapped about that to provide some electrical isolation. A plastic case or housing is positioned around the topmost magnet and coil assembly. The coil serves as a pick-up, and it is connected to a suitable output cable.

BRIEF DESCRIPTION OF THE DRAWINGS

FIG. 1 is a top view showing the location of the pick-up of the present invention on a guitar body;

FIG. 2 is a perspective view of the guitar pick-up detached from the guitar and showing its construction on the bottom side;

FIG. 3 is a sectional view through the guitar pick-up showing how it is mounted on a guitar body and internal details of construction; and FIG. 4 is a top view of the guitar pick-up of the present invention with a portion of the covering broken away.

DETAILED DESCRIPTION OF THE ILLUSTRATED EMBODIMENT

In the drawings, a guitar pick-up is identified generally at 10 in FIG. 1, where it is affixed to an acoustic guitar 12. The guitar 12 has a body 14 and a set of strings 16. The strings extend from the neck 18 over a bridge 20, and they are pulled taut above the guitar body 14. The guitar is of standard construction for acoustic guitars and typically includes six strings. The present invention will, of course, operate with a twelve-string guitar, also.

The guitar pick-up 10 is better shown in the additional drawings. In particular, FIG. 3 discloses the guitar body 14, partly broken away, where a first magnet is adhesively attached. The first magnet is identified by the numeral 24. The numeral 26 identifies an adhesive. Any type of adhesive may be used, including those which are protected under a tin foil covering which is peeled away at 28, better shown in FIG. 2 of the drawings. The adhesive is located on the bottom side of the first magnet 24. The first magnet is a sheet magnet. It is cut in a rectangular form. The approximate size is about one-half inch (½") by four inches (4"). The length is sufficient to span all the strings on the guitar. This preferred length enables the device to pick up vibrations from all the strings as will be described. Further, the device is formed so that there are magnetic poles, one on the top face and one on the bottom face. The material which has been chosen for the magnetic bar 24 is a flexible or bendable material. More will be noted concerning this hereinafter. It has only slight thickness, typically in the range of about one-eighth inch (⅛").

The numeral 30 identifies a second magnet which is similar to the first. It also is cut in a rectangular shape, and the two magnets are approximately the same size. They are also formed of about the same thickness. The magnet 30 serves other purposes. It is a central core for a coil 32 which is wound about it. The coil 32 is formed of many turns of fine wire wound in a rectangle around it. The multiple turns of wire are supported on the magnet 30. They are located around the periphery. They are kept at the periphery and enclosed or encompassed by an aluminum foil wrapper at 36. The aluminum foil provides electrical shielding, but not magnetic shielding. It also provides some mechanical support so that the turns of the coil are held in position. If desired, the coil, after it has been formed, can be doped with an epoxy resin which cures to a flexible mass to hold the turns of the coil in position. The layer of tin foil at 36 is exaggerated in thickness; it can be quite thin, there being no minimum requirements. On the other hand, it has been sufficiently thick to withstand wear and tear during manufacturing.

The outer layer is a plastic case or housing 40 which is wrapped around and which encompasses the bar magnet 30, the coil 32 and the tin foil 36. A shrink plastic body will suffice. Several plastics are known which are available in tubular stock which shrink upon the application of heat or other setting catalyst. The plastic body shrinks around the magnet and other components to pull them together and to hold them snugly against one another. Moreover, the plastic body encompasses the structure so that a neat, well-defined package is formed.

The lower magnet 24 is preferably joined to the plastic housing 40 by means of a suitable adhesive. When finished, a somewhat rectangular structure having a pair of wires protruding at one end is defined. The rectangular structure is better shown in FIG. 4. There, FIG. 4 shows the plastic body broken away to reveal the top magnet 30, the coil 32 around it and a pigtail 42 which encases two wires connected in series with the coil.

The two wires, of course, are placed in a sheath and insulated from one another, and they extend to some type of amplification apparatus. The numeral 44 identifies surplus plastic casing which has been heat-shrunk or catalyst-reacted to shrink, adhere and form a tab. It serves no structural purpose, but it does function as a continuation of the sleeve material which is used in the fabrication of the device.

The present invention has certain physical characteristics which are reasonably important. The device, if clamped in a vice, evidences a bendable construction. It can be bent, flexed or otherwise deflected. A force of about ten pounds applied at the opposite end when held in a cantilevered position will deflect the end approximately one-half inch (½") or so. The deflection is a result of the plastic construction used. That is to say, the magnets are not formed of metal; rather, they are formed of metal particles embedded in a plastic base. The plastic housing 40 is also flexible, and the coil 32 is also flexible. In sum and in substance, all of the materials which are used are bendable or flexible. Thus, a sandwich of approximately one-quarter inch (¼") is defined (see FIG. 3) which flexes or bends. The flexibility is advantageous in converting acoustic guitar body vibrations into an electrical signal.

The device functions in the following manner. Strings positioned above the magnet 30 form electrical signals in the coil 32 on movement. Such vibrations are converted into electrical signals by the electromagnetic coupling from the magnet 30 to the strings under the assumption the strings are made of ferromagnetic materials. The signal formed in the output coil is transferred to a suitable amplifier. If a string is stationary, no signal is formed. Quite obviously, if a string is moving, its movement is determined by the vibration frequency plus overtones reflected in the string by its movement, and these are transferred to the coil via magnetic coupling.

The present invention is advantageous over prior art devices in the provision of the magnet 24. The magnet 24 is sensitive to vibrations in the acoustic guitar body 14. Such vibrations are controlled by the construction of the body so that certain harmonics are emphasized, while other vibration modes are suppressed. The guitar functions in the customary manner, and its vibrations are imparted to the lower magnet 24. This magnet is not rigidly constructed. It is able to flex, and such flexure is converted into movements of the magnet 24. So to speak, the magnet 24 pitches and heaves almost in the fashion of a boat on rough water to create its own component in the output signal.

The present invention is certainly not detrimental to the guitar. It can be attached and later removed. This depends on the nature of adhesive used, and it is preferable to use an adhesive which can be overcome by finger forces applied to the device.

The foregoing is directed to the preferred embodiment, but the scope of the present invention is determined by the claims which follow.

I claim:

1. A pick-up for a stringed instrument having an acoustic body which comprises:

(a) a first flexible magnet adapted to be attached to the acoustic body of a stringed instrument;

(b) a second flexible magnetic body forming magnetic lines of flux which co-act with strings of the instrument to form magnetic field disturbances;

(c) a wound coil which is positioned such that the magnetic field of the second magnet is disturbed for the purpose of forming an electrical signal in said coil as a result of the movement of the strings of the musical instrument;

(d) said first magnet being sufficiently flexible and movable when mounted on the acoustic body to impart vibrations from the body to a magnetic field formed by said first magnet such that an electrical signal is formed in said coil which is at least partly dependent on the vibrations in said acoustic body;

(e) an adhesive means for joining said first magnet to the acoustic body; and (f) a second adhesive means for joining the first magnet to the second magnet.

2. A pick-up for a stringed instrument having an acoustic body which comprises:

(a) a first flexible magnet adapted to be attached to the acoustic body of a stringed instrument;

(b) a second flexible magnetic body forming magnetic lines of flux which co-act with strings of the instrument to form magnetic field disturbances;

(c) a wound coil which is positioned such that the magnetic field of the second magnet is disturbed for the purpose of forming an electrical signal in said coil as a result of the movement of the strings of the musical instrument;

(d) said first magnet being sufficiently flexible and movable when mounted on the acoustic body to impart vibrations from the body to a magnetic field formed by said first magnet such that an electrical signal is formed in said coil which is at least partly dependent on the vibrations in said acoustic body; and (e) a metallic shield of nonferromagnetic material surrounding said coil to provide an electrostatic shield thereabout.

3. The apparatus of claim 2 including an elongate shrink-fit plastic sleeve encasing said second magnet, coil and electrostatic shield therein and including a sleeve which encloses a pair of wires extending remotely therefrom which are connected to said coil.

4. The apparatus of claim 3 wherein said first and second magnets are formed of plastic material and have magnetic poles on the upper and lower faces thereof.

5. The apparatus of claim 4 wherein said first magnet is adhesively joined to said plastic sleeve and forms a unitary structure of generally rectangular shape which is flexible and bendable so that it is able to deflect along the length thereof.

6. The apparatus of claim 5 wherein said rectangular structure has a length at least spanning the total width of all the strings on the stringed instrument.

* * * * *